US005766032A

United States Patent [19]

LaPointe et al.

[11] Patent Number: 5,766,032

[45] Date of Patent: Jun. 16, 1998

[54] THEFT-RESISTANT ASSEMBLY FOR FLUORESCENT LAMPS

[75] Inventors: James W. LaPointe, Lynnfield, Mass.; Robert W. Campbell, Holland, Mich.

[73] Assignees: Osram Sylvania Inc., Danvers, Mass.; Prolight, Holland, Mich.

[21] Appl. No.: 780,907

[22] Filed: Jan. 9, 1997

[51] Int. Cl.[6] ..... H01R 13/62

[52] U.S. Cl. ..... 439/371; 439/366

[58] Field of Search ..... 439/371, 233, 439/232, 234, 236, 359, 360, 366, 242

[56] References Cited

U.S. PATENT DOCUMENTS

| | | | |
|---|---|---|---|
| 4,637,671 | 1/1987 | Johnson et al. | 339/50 R |
| 4,811,183 | 3/1989 | Guritz et al. | 362/377 |
| 4,936,789 | 6/1990 | Ugalde | 439/236 |
| 5,065,292 | 11/1991 | Aubrey | 362/260 |
| 5,424,610 | 6/1995 | Pelton et al. | 315/58 |

*Primary Examiner*—Khiem Nguyen
*Assistant Examiner*—Eugene G. Byrd
*Attorney, Agent, or Firm*—Carlo S. Bessone

[57] ABSTRACT

A theft-resistant assembly for screw base compact fluorescent lamps of the type having at least one U-tube integrated with and extending from an adapter member. The adapter member has a threaded portion for engagement with a lamp socket. The assembly includes a ring for disposition around a protrusion of the lamp socket protrusion, arms upstanding from the ring with each of the arms having an arm connector thereon, a collar for disposition around the U-tube and for engagement with a top surface of the adapter member, and legs depending from the collar with each of the legs having a leg connector thereon. The leg connectors are lockingly engageable with the arm connectors, respectively, to lock the collar to the ring, whereby to lock the adapter member to the socket.

12 Claims, 3 Drawing Sheets

THEFT-RESISTANT ASSEMBLY FOR FLUORESCENT LAMPS

FIELD OF THE INVENTION

This invention relates to apparatus for deterring theft of fluorescent light bulbs, and is directed more particularly to an assembly for deterring theft of screw base compact fluorescent light bulbs from lamps in which the fluorescent bulbs are mounted in sockets for conventional incandescent light bulbs.

BACKGROUND OF THE INVENTION

The advantages of fluorescent bulbs over incandescent bulbs of equivalent light intensity are well known. Though initially more expensive, the additional cost is more than offset by reduced energy consumption and extended operating life.

To benefit from the advantages of fluorescent lighting, adapters have been developed which facilitate replacing conventional incandescent light bulbs with compact U-shaped fluorescent bulbs. Adapters typically include a starter circuit and ballast transformer. The U-shaped bulb that is used with the adapter usually includes, at a base portion thereof, a pair of terminal pins that plug into matching receptacles on the adapter to connect the fluorescent bulb to the ballast transformer and starter circuit. The adapter is threaded so that it readily can be installed in a conventional incandescent light socket, common in table lamps and floor lamps.

It is known to provide interlocking means in adapters for securing the U-tube in the adapter, for preventing easy removal of the U-tube from the adapter. Such means are shown and described in U.S. Pat. No. 4,637,671, issued Jan. 20, 1989, to George E. Johnson, et al; and U.S. Pat. No. 4,811,183, issued Mar. 7, 1989, to Kenneth E. Guritz, et al. In typical incandescent lamps, it is easy to remove the incandescent bulb from the socket, by simply unscrewing the bulb from the socket. Similarly, while the U-tube of a fluorescent bulb may be locked into an adapter, the adapter itself can be readily unscrewed from the socket and removed.

Attempts have been made to render such pilferage useless, or physically difficult. In U.S. Pat. No. 5,065,292, issued Nov. 12, 1991, to Truman R. Aubrey, there is disclosed an assembly for converting an incandescent table lamp to a fluorescent table lamp, which assembly includes a ballast remote from the bulb and adapted for locking engagement with a wall outlet receptacle. Aubrey further suggests applying glue to the adapter screw threads prior to screwing the adapter into the lamp socket. Accordingly, removal of the adapter and bulb is discouraged by the glue, but even if removed is lacking the ballast necessary for operation.

In U.S. Pat. No. 4,936,789, issued Jun. 26, 1990, to Joseph Ugalde, there is presented means for preventing removal of an adapter from a socket. The adapter threaded portion is provided with an inset annular split ring which serves to lock the adapter threaded portion into the lamp socket. After installation, the adapter cannot be unscrewed from the socket.

In U.S. Pat. No. 5,424,610, issued Jun. 13, 1995, to Bruce A. Pelton, et al, there is shown means for locking a harp (lamp shade support) onto a fixture to prevent removal of the harp, to render difficult removal of the adapter and bulb.

The long-term benefits of fluorescent bulbs, as opposed to incandescent bulbs, are attractive to hotel and motel operators, but theft of the fluorescent bulbs, of course, counteracts the otherwise expected savings and discourages large-scale use of the fluorescent bulbs.

Use of permanent bonds between adapters and sockets is not favored inasmuch as it is preferable to simply unscrew and discard used-up bulbs and adapters and replace them by screwing in new bulb and adapter assemblies. In short, it is desired to make bulb removal easy for hotel and motel maintenance people, but difficult for pilferers. Further, it is desirable to retain the ballast in the adapter so that lamps may be used interchangeably for incandescent or fluorescent bulbs. Still further, in view of the high initial costs of the fluorescent assemblies, it is essential that any theft deterrent means added thereto be of extremely low cost.

SUMMARY OF THE INVENTION

In view thereof, an object of the invention is to provide a theft-resistant assembly for fluorescent bulb and adapter combinations.

A further object of the invention is to provide such an assembly which affords theft deterrence without requiring placement of the ballast remote from the bulb and adapter combination, such that the only steps required to transform an incandescent lamp to a fluorescent lamp are to (1) replace the incandescent bulb with a fluorescent bulb, and (2) attach the theft-resistant assembly described herein to the bulb and adapter combination and to the lamp socket.

A still further object of the invention is to provide such an assembly not requiring permanent attachment of the adapter to the socket, thereby permitting release of the bulb and adapter when a change of bulbs is in order.

A still further object of the invention is to provide such an assembly which is of extremely low cost and can be installed by maintenance people having little or no knowledge of electricity, but which deters theft by pilferers.

With the above and other objects in view, as will hereinafter appear, a feature of the present invention is the provision of a theft-resistant assembly for fluorescent lamps of the type having at least one U-tube integrated with and extending from an adapter member, the adapter member having a threaded portion for engagement with a lamp socket, and the lamp socket having a protrusion by which the lamp socket is secured to a lamp base. The assembly comprises a ring for disposition around the socket protrusion, arms upstanding from the ring, each of the arms having an arm connector thereon, a collar for disposition around the U-tube and for engagement with a top surface of the adapter member, and arms depending from the collar, each of the arms having an arm connector thereon. The arm connectors are lockingly engageable with the leg connectors, respectively, to lock the collar to the ring, whereby to lock the adapter member to the socket.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

BEST MODE FOR CARRYING OUT THE INVENTION

Figure 1:
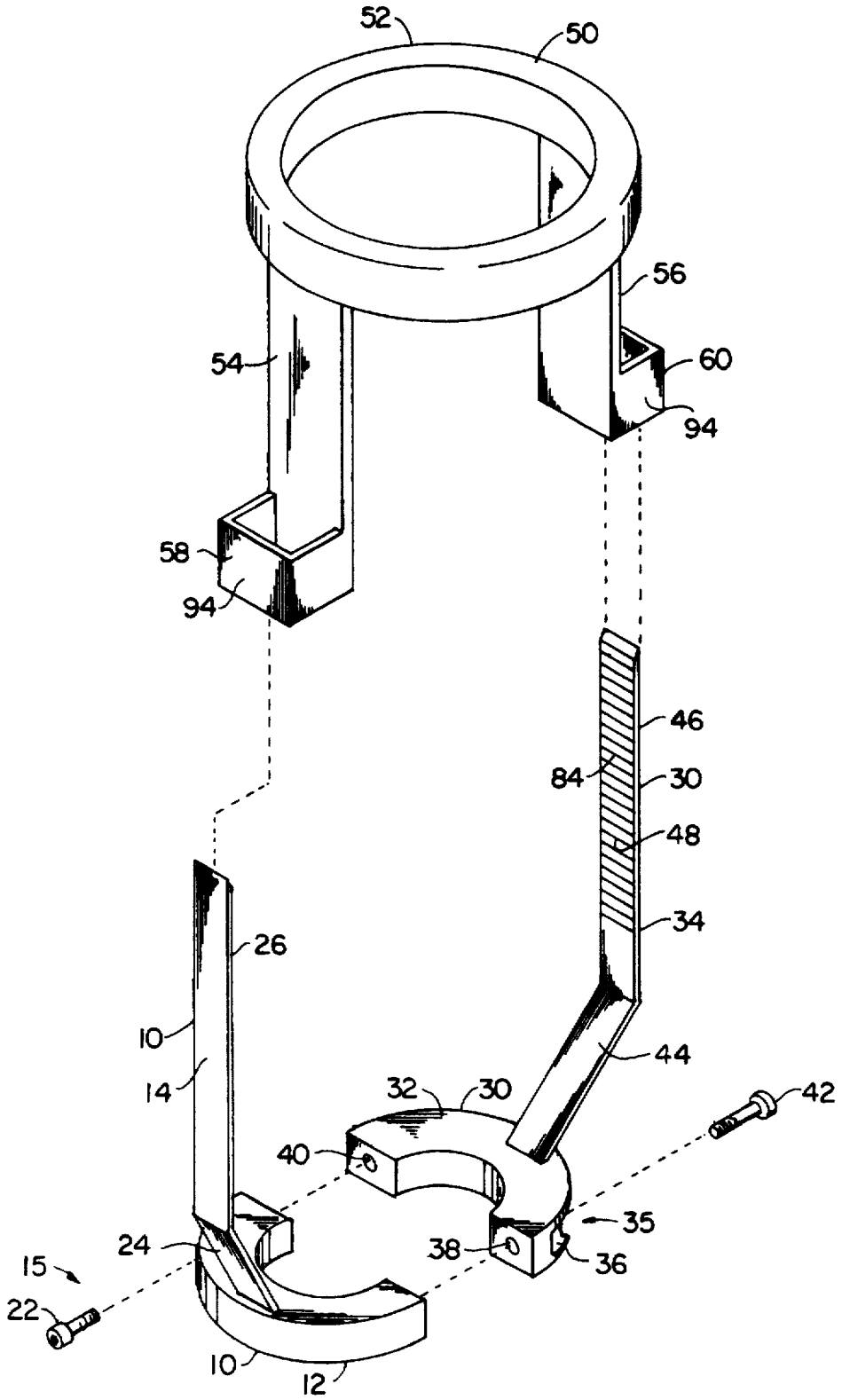
FIG. 1 is a perspective exploded view of one form of theft-resistant assembly illustrative of an embodiment of the invention.

Referring to FIG. 1, it will be seen that a preferred embodiment of theft-resistant assembly for fluorescent lamps includes a first member 10, a second member 30, and a third member 50.

Figure 3:
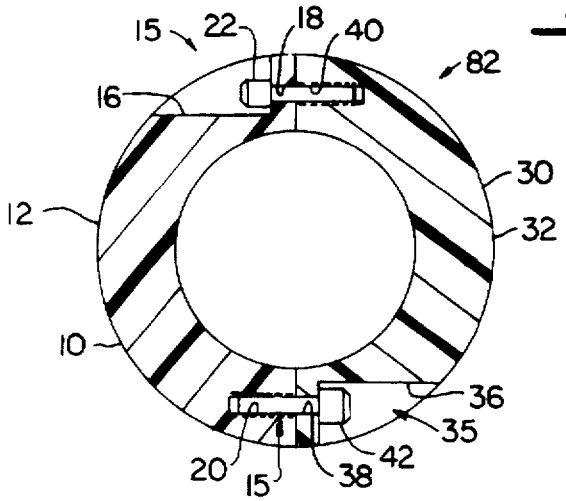
FIG. 3 is a sectional view taken along line III—III of FIG. 2.

The first member 10 is provided with a first semi-annular ring portion 12 and a first arm portion 14. The ring portion 12 is provided with first ring connectors 15 thereon such as, for example, one or the other, or both, of (1) a recess 16 and hole 18 in communication therewith (FIG. 3), and (2) a threaded hole 20. The first ring connectors 15 further include at least one screw 22 which is insertable through the recess 16. The threaded hole 20 is adapted to receive a screw similar to the screw 22. The first arm portion 14 includes a first base portion 24 upstanding from the first ring portion 12 and may be integral with the ring portion 12, and a first locking arm portion 26 which may be integral with the first base portion 24. The first locking arm portion 26 is provided with a first arm connector 28, to be described hereinbelow.

Similarly, the second member 30 is provided with a second semi-annular ring portion 32 and a second arm portion 34. The ring portion 32 is provided with a second ring connector 35 thereon such as one or the other, or both, of (1) a recess 36 and hole 38 in communication therewith, and (2) a threaded hole 40. The second ring connector 35 further includes at least one screw 42 which is insertable through the recess 36. The threaded hole 40 is adapted to receive the screw 22 and the threaded hole 20 is adapted to receive the screw 42. The second arm portion 34 includes a second base portion 44 upstanding from the second ring portion 32 and may be integral with the ring portion 32, and a second locking arm portion 46 which may be integral with the second base portion 44. The second locking arm portion 46 is provided with a second arm connector 48, to be described hereinbelow.

It will be apparent that the connectors 15, 35 on the first and second ring portions 12, 32 may both be threaded holes, as at 20, 40, or may both be recesses and holes, as at 16, 18 and 36, 38. Thus, both screws 22, 42 may be introduced through one of the first and second ring portions 12, 32 and received by the other, to join the first and second members 10, 30 together.

The third member 50 includes a collar portion 52, a first leg portion 54 depending from the collar portion 52, and a second leg portion 56 depending from the collar portion 52. The first leg portion 54 is provided with a first leg connector 58 and the second leg portion 56 similarly is provided with a second leg connector 60.

The above-described assembly is for use with a screw base compact fluorescent lamp (shown in phantom in FIG. 2) having one or more U-tubes 70 integrated with and extending from an adapter member 72. The adapter member is provided with a threaded portion 74 which engages with an internally threaded socket 76 of the type generally found in incandescent lamps. The lamp socket 76 is provided with a protrusion 75 including a tubular portion 77 which retains, as by a set screw 79, a threaded portion 78 by which the socket 76 is mounted on a lamp base 80, as by screwing the protrusion portion 78 into a threaded hole in the lamp base 80, or by extending the protrusion portion 78 through a hole in the lamp base 80 and locking the protrusion portion 78 therein with a nut (not shown) on the inside of the lamp base 80. The lamp described immediately above is known in the art and is typical of incandescent lamps and typical of lamps often sought to be converted to fluorescent.

In using the theft resistant assembly herein, the first and second ring portions 12, 32 are connected together by the first and second ring connectors 15, 35, such as screws 22, 42 advanced through recesses 16, 36 and holes 18, 38 and into threaded holes 20, 40 respectively, to form a complete ring 82 (FIG. 3) around the socket protrusion 75, thereby locking the ring 82 between the socket 76 and the lamp base 80. The collar portion 52 is then slipped over the one or more U-tubes 70 and moved toward the lamp base 80.

Figure 2:
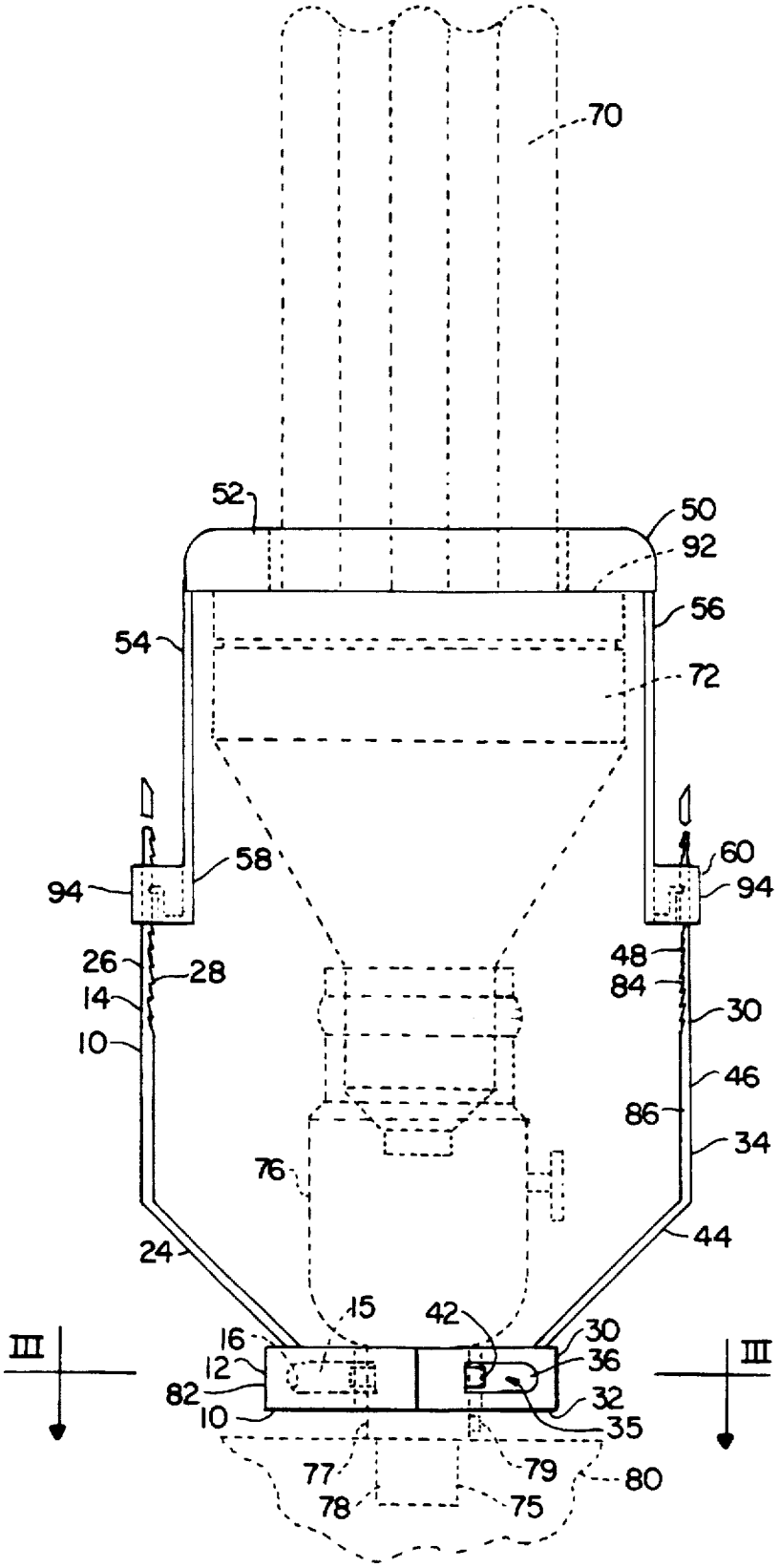
FIG. 2 is a side elevational view of the components of FIG. 1 assembled together and in place on a table lamp.
Figure 4:
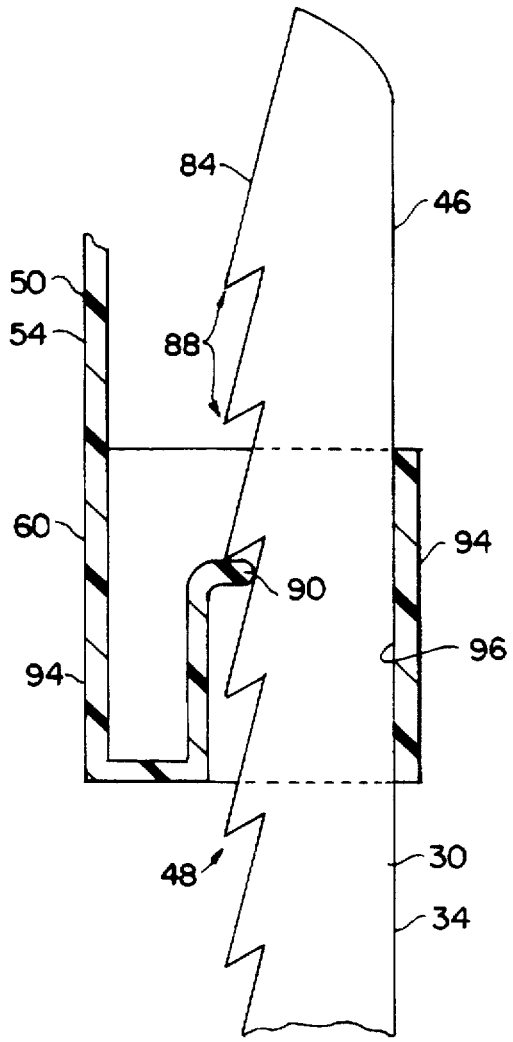
FIG. 4 is an enlarged side elevation, partly sectional, view of components of the assembly of FIG. 2.

Referring to FIG. 4, there is shown an enlarged elevational, partly sectional view of the second arm connector 48 which comprises second arm tooth means 84 on a surface 86 of the second arm 34. The tooth means 84 comprises a series of teeth 88 disposed in a line substantially axially of the socket 76, as shown in FIG. 2. The second leg connector 60 comprises a tooth 90 (FIG. 4) movable along the line of teeth 88 in a direction toward the lamp base 80, to move the collar 52 and ring 82 closer together. However, once the collar 52 engages a top surface 92 of the adapter 72, the tooth 90 cannot be moved in the opposite direction. Thus, the second leg connector 60 and the second arm connecter 48 are locked together.

Referring again to FIG. 4, it will be seen that the second leg connector 60 comprises a four-sided body 94 defining a passageway 96 therethrough. The series of rachet-like teeth 88 is movable through the passageway 96 in one direction only.

The first leg connector 58 and first arm connector 28 are substantially the same in configuration and function as the second leg connector 60 and second arm connector 48. Thus, the locking arm portions 26, 46, which are substantially parallel to each other and to the axis of the socket 76, lock to the legs 54, 56 to lock the adapter member 72 and socket 76 therebetween. The four-sided bodies 94 prevent easy separation of the tooth 90 and ratchetlike teeth 88. Upon completion of the locking operation, the adapter member 72, having the U-tube 70 locked therein, is locked in place.

It will be appreciated that the teeth 88 could just as well be placed on one or more of the arms 14, 34, and the tooth 90 on one or more of the legs 54, 56.

It is recognized that diligent work on the part of a thief will, in due course, uncouple the first and second locking arm portions 26, 46 from the third member 50. It is further recognized that the legs 54, 56 or arms 14, 34 can be cut with heavy shears. However, most light bulb pilferage occurs, in large measure, because the removal of a light bulb is easy and not time-consuming. By rendering the bulb removal process more complicated and time-consuming, rampant pilferage thereof is diminished substantially.

The application of the assembly herein is a relatively simple mechanical operation and can be performed by low-skill maintenance personnel. When the time comes to remove and replace the bulb, an operator unscrews the screws 22, 42 to separate the ring portions 12, 32 from each other, to permit the assembly to be lifted from the integrated bulb and adapter combination, which may then be easily removed and replaced. The assembly is then locked in place to deter theft of the new bulb, all in a matter of seconds.

The assembly preferably is of molded plastic and molded in three parts, i.e., the first member 10, second member 30, and third member 50. The first and second members 10, 30 may be identical and therefore produced in the same mold cavity. The cost for the assembly is accordingly minimal.

There is thus provided a theft-resistant assembly for the protection of fluorescent bulbs in incandescent table lamps, and the like. The assembly is inexpensive to manufacture and easily installed, and does not require special provision for ballasts.

It is to be understood that the present invention is by no means limited to the particular construction herein disclosed and/or shown in the drawings, but also comprises any modifications or equivalents within the scope of the claims.

What is claimed is:

1. A theft-resistant assembly for screw base compact fluorescent lamps of the type having at least one U-tube integrated with and extending from an adapter member, the adapter member having a threaded portion for engagement with a lamp socket, the lamp socket having a protrusion by which the lamp socket is secured to a lamp base, the assembly comprising:

a ring for disposition around the socket protrusion;

arms upstanding from said ring, each of said arms having an arm connector thereon;

a collar for disposition around the U-tube and for engagement with a top surface of the adapter member;

legs depending from said collar, each of said legs having a leg connector thereon;

said leg connectors being lockingly engageable with said arm connectors, respectively, to lock said collar to said ring, whereby to lock the adapter member to the socket.

2. The assembly in accordance with claim 1 wherein said ring includes a plurality of segments connectable together around the socket protrusion, at least two of said segments each having one of said arms upstanding therefrom.

3. The assembly in accordance with claim 1 wherein said arm connectors each comprises arm tooth means on a surface of one of said arms.

4. The assembly in accordance with claim 3 wherein said leg connectors each comprises leg tooth means lockingly engageable with one of said arm connector tooth means.

5. The assembly in accordance with claim 4 wherein one of said leg tooth means and said arm tooth means comprises a series of teeth disposed in a line substantially axially of the socket, and the other of said leg tooth means and said arm tooth means comprises a tooth movable along said line of teeth in a first direction moving said collar and said ring closer together, but not movable in an opposite direction, whereby to lock said collar to said ring with a selected distance therebetween.

6. The assembly in accordance with claim 5 wherein said other of said tooth means comprises a four-sided body defining a passageway therethrough, and said tooth is disposed in said passageway, said series of teeth being movable through said passageway in said first direction and in engagement with said tooth, said engagement of said tooth with said series of teeth being such as to prevent movement of said series of teeth in said passageway in said opposite direction.

7. A theft-resistant assembly for screw base compact fluorescent lamps of the type having at least one U-tube integrated with and extending from an adapter member, the adapter member having a threaded portion for engagement with a lamp socket, the lamp socket having a protrusion at least in part threaded for engagement with a nut by which the lamp socket is secured to a lamp base, the theft-resistant assembly comprising:

a first member comprising a first semi-annular ring portion and a first arm portion upstanding from said first ring portion, said first arm portion having a first arm connector thereon and said first ring portion having a first ring connector thereon;

a second member comprising a second semi-annular ring portion and a second arm portion upstanding from said second ring portion, said second arm portion having a second arm connector thereon and said second ring portion having a second ring connector thereon; and a third member comprising a collar portion, a first leg portion depending from said collar portion and having a first leg connector thereon, and a second leg portion depending from said collar portion and having a second leg connector thereon;

said first and second ring portions being connectable together around the socket protrusion by engagement of said first and second ring connectors, said collar portion being disposable around the U-tube and engageable with a top surface of the adapter member, said first leg connector being lockingly engageable with said first arm connector, and said second leg connector being lockingly engageable with said second arm connector, to lock said third member to said interconnected first and second members, whereby to lock the adapter member to the socket.

8. The assembly in accordance with claim 7 wherein said first and second arm connectors each comprises a series of ratchet teeth disposed along a portion of the length of the respective arms.

9. The assembly in accordance with claim 8 wherein at least portions of said arms extend substantially parallel to a longitudinal axis of the socket.

10. The assembly in accordance with claim 9 wherein said arm portions are generally planar and said teeth are disposed on sides of said arm portions.

11. The assembly in accordance with claim 8 wherein each of said leg connectors comprises a body proximate a distal end of the respective leg, said body defining a passageway therethrough for receiving one of said arm portions, and said leg connector further comprises a tooth in said body for engaging said ratchet teeth of said one arm portion and permitting movement of said one arm portion through said passageway in a first direction in which said collar portion and said interconnected ring portions are drawn toward one another, and preventing movement of said one arm portion through said passageway in an opposite direction.

12. The assembly in accordance with claim 11 wherein at least one of said tooth and said ratchet teeth is of a plastic material.

* * * * *